United States Patent [19]

Wilkinson et al.

[11] 4,029,263

[45] June 14, 1977

[54] BALLISTIC PULVERISER SEPARATOR

[75] Inventors: Albert Edward Roy Wilkinson, Sheffield; Nigel Dane Quartano Candler, Hungerford, both of England

[73] Assignee: Tollemache Environmental Engineers Limited, Surbiton, England

[22] Filed: Mar. 31, 1975

[21] Appl. No.: 563,511

[52] U.S. Cl. ..... 241/188 R; 241/79.1; 241/194

[51] Int. Cl.[2] ..... B02C 13/282

[58] Field of Search ..... 241/79.1, 188 R, 189 R, 241/189 A, 194

[56] References Cited

UNITED STATES PATENTS

| | | | |
|---|---|---|---|
| 2,809,400 | 10/1957 | Maltenfort | 241/189 R X |
| 2,879,005 | 3/1959 | Jarvis | 241/79.1 X |
| 3,040,995 | 6/1962 | Steiniger | 241/79.1 |
| 3,044,719 | 7/1962 | May | 241/194 |
| 3,356,016 | 12/1967 | Eidal | 241/188 R X |
| 3,577,998 | 5/1971 | Pinkman | 241/188 R X |
| 3,851,829 | 12/1974 | Dopper et al. | 241/188 R |

*Primary Examiner*—Roy Lake
*Assistant Examiner*—Howard N. Goldberg
*Attorney, Agent, or Firm*—Fleit & Jacobson

[57] ABSTRACT

A pulveriser separator principally intended for handling refuse such as garbage including a housing having an upwardly divergent funnel portion and a downwardly depending skirt portion, and at least one hammer mounted for rotation about a substantially vertical axis within the housing, the funnel portion consisting of a plurality of imperforate pulveriser plates disposed to provide a polygonal cross-sectional inner periphery for the funnel.

6 Claims, 2 Drawing Figures

15
18
15
18
Y
Z
32
37A
35
38A
38
33
33
37
43
33A
42
36
33A
44
34
45
X

BALLISTIC PULVERISER SEPARATOR

The present invention relates to pulverisers, such as pulveriser-separators. In one form of pulveriser-separator, which is particularly suitable for pulverising refuse, a conical hopper-shaped container is disposed with its axis vertical and a rotor is rotatable within the container about a vertical axis. The rotor carries hammers or flails and a downdraught is produced by its rotation, or otherwise, so that light particles and crushable materials are drawn downwardly while resilient particles are thrown against the wall of the container, which deflects them upwardly and outwardly.

The remaining separated material is drawn downwardly into a substantially cylindrical portion, below the conical container, in which it is further pulverised by hammers carried by the rotor. This arrangement, is generally satisfactory, but the throughput of the apparatus is restricted by the flow which the cylindrical portion is capable of handling.

According to the present invention, we provide a pulveriser-separator including a housing having an upwardly divergent funnel portion and a downwardly depending skirt portion, and at least one hammer mounted for rotation about a substantially vertical axis within the housing, the funnel portion consisting of a plurality of imperforate pulveriser plates disposed to provide a polygonal cross sectional inner periphery for the funnel. In a preferred construction the housing is a downwardly tapered 12 faced housing.

Advantageously the skirt portion is provided with a lateral extension forming a cyclone separator. For this purpose the skirt portion may comprise a major circumferential portion of a right cylinder and the later extension may be formed by a wall connected to the cylinder to be tangential thereto with a portion of the tangential wall remote from the cylinder being curved to present a concave face to the cylinder. An air outlet may be provided at the top of the cyclone separator portion and a discharge conveyor at the bottom.

In a most advantageous construction, the cyclone separator portion is formed by two tangential walls, at an acute angle to one another, each connected at one end to the cylindrical portion, the two tangential portions being joined together at their other ends remote from the axis of the rotor, by an arcuate wall. With such an arrangement, the cyclonic separation may be effected in either direction of rotation of the rotor. This is most important because, if the rotor can be rotated in either direction, both edges of the hammers can be used before the hammers have to be replaced due to wear.

Preferably, the cyclone separator portion is removable as a unit from the remainder of the apparatus for servicing. This may be effected by mounting the separator on wheels running on rails. Desirably, the bottom of the cyclone separator, which may be formed by a discharge conveyor, is below the bottom wall of the cylindrical portion and a sloping, generally radially extending, base is provided, to improve discharge of material from the cylindrical portion and to discourage the return of material thereto from the cyclone separator.

Conveniently the funnel portion is constructed to have outer skin plates and inner skin plates. The inner skin plates may be replaced from time to time due to wear. The inner skin plates may be provided with slotted pegs which pass through apertures in the outer skin plates and wedges are forced into the slots of the pegs to secure the inner skin plates in position. The inner skin plates may be formed of several parts in the depth of the container for example, three parts, the lowermost part being formed of cast manganese steel, since it is in this region that the pulverising takes place. Thus in a preferred construction according to the invention, the inner skin is formed of 36 plates, three in each of the 12 faces.

Preferably the drive to the rotor is provided by an electric motor mounted at the upper end of the rotor shaft, which is itself mounted for rotation about a vertical axis in a footstep bearing mounted on the floor of the apparatus below the cylindrical portion.

The drive between the electric motor and the rotor shaft is preferably through a fluid connection for example, a powder fluid connection arranged so that should the rotor become blocked, so that it cannot rotate, the powder is released, and the motor is not burnt out. Preferably, a current sensitive overload circuit breaker is provided to give a dual safety arrangement.

In order that the invention may more readily be understood the following description is given, reference being made to the accompanying drawings in which.

Figure 1:
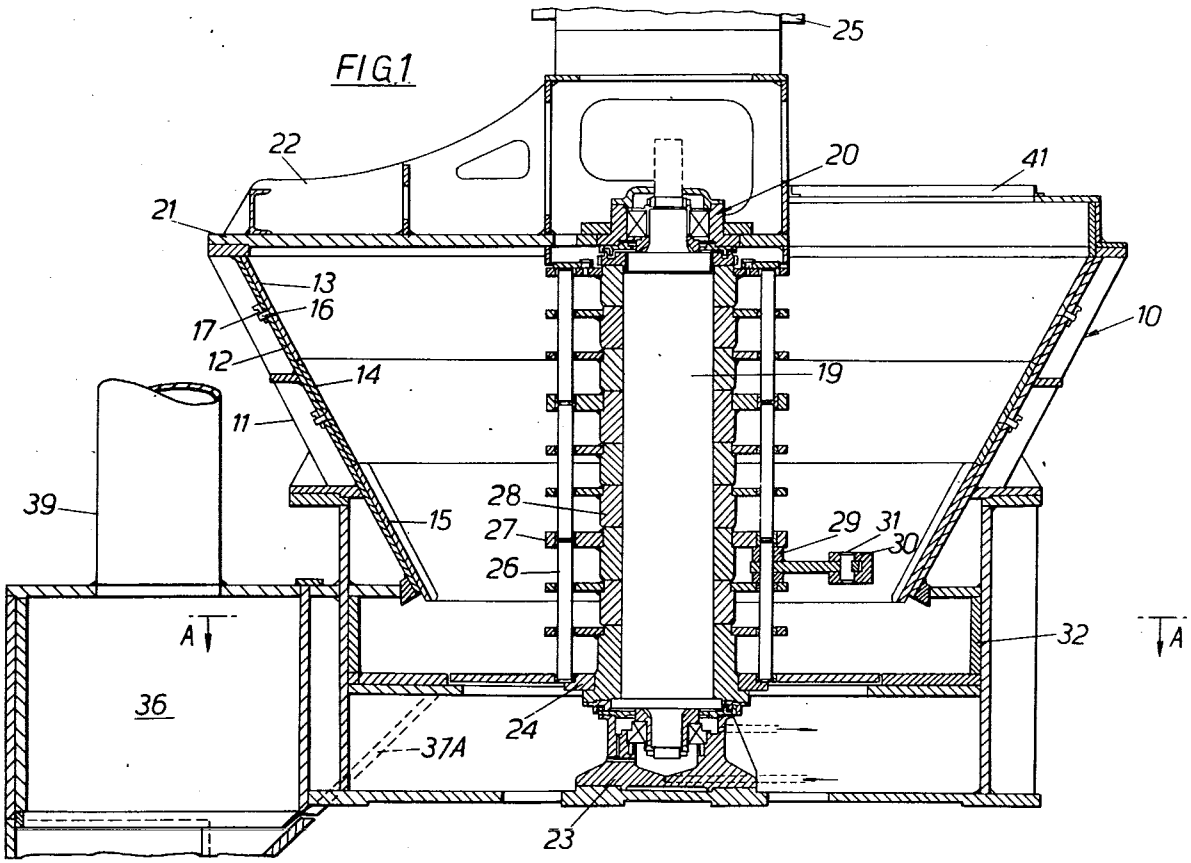
FIG. 1 is a section along the line XYZ of FIG. 2.

Referring now to the drawings there is illustrated a downwardly tapered dodecahedral housing 10. Each of the twelve faces is reinforced on a pair of frame members 11 and includes an outer skin plate 12 welded to the frame members. Located within each of the outer skin plates are three inner skin plates 13, 14 and 15. The plates 13 and 14, formed of armour plate, are secured by pegs 16 projecting through apertures in the plates 12 the pegs themselves being slotted to receive wedges 17. As can be seen more particularly from FIG. 2 the lower plates 15, which are formed of cast manganese steel, are provided with inwardly projecting ribs 18, the plates being self supporting. Mounted for rotation within the container is a vertical rotor shaft 19, this being carried in an upper bearing 20 held in an upper plate 21, which is reinforced by an assembly 22. The lower end of the shaft is mounted in a footstep bearing 23 and rotatable with the rotor shaft is a lower plate 24. Rotation of the rotor shaft 19 is effected by an electric motor 25 through the intermediary of a powder filled fluid drive (not shown). Extending upwardly from the lower plates 24 are 12 vertical shafts 26 which are held in position by assembly plates 27 themselves carried by collars 28, which are keyed to the shaft 19. Each of the pins carries a number of flails 29, each being rockable about the associated shaft 26, each flail having at its radially outer end a hammer assembly 30 which is removably mounted on the flail by a pin 31. The flails can be disposed in a generally helical array so that rotation of the shaft causes a downdraught of air through the container 10.

Disposed below the housing 10 is a generally cylindrical portion 32, which surrounds the lower-most flails carried by the rotor. As can be seen more particularly with reference to FIG. 2, the cylindrical portion 32 is extended laterally outwardly on one side by generally tangential walls 33, these being joined at their ends remote from the rotor axis by arcuate wall 34. A further arcuate wall 35 is disposed radially inwardly of the wall 34, with respect to the rotor, to form a separation chamber 36. This separation chamber 36 is thus joined to the cylindrical portion 32 by two passageways 37 and 38, the lower portion of these passageways being defined by a downwardly sloping base 37A, 38A. The upper most portion of the separation chamber 36 is provided with an air extracting pipe 39, while a discharge conveyor (not shown) is located at the lower area of the chamber 36.

Figure 2:
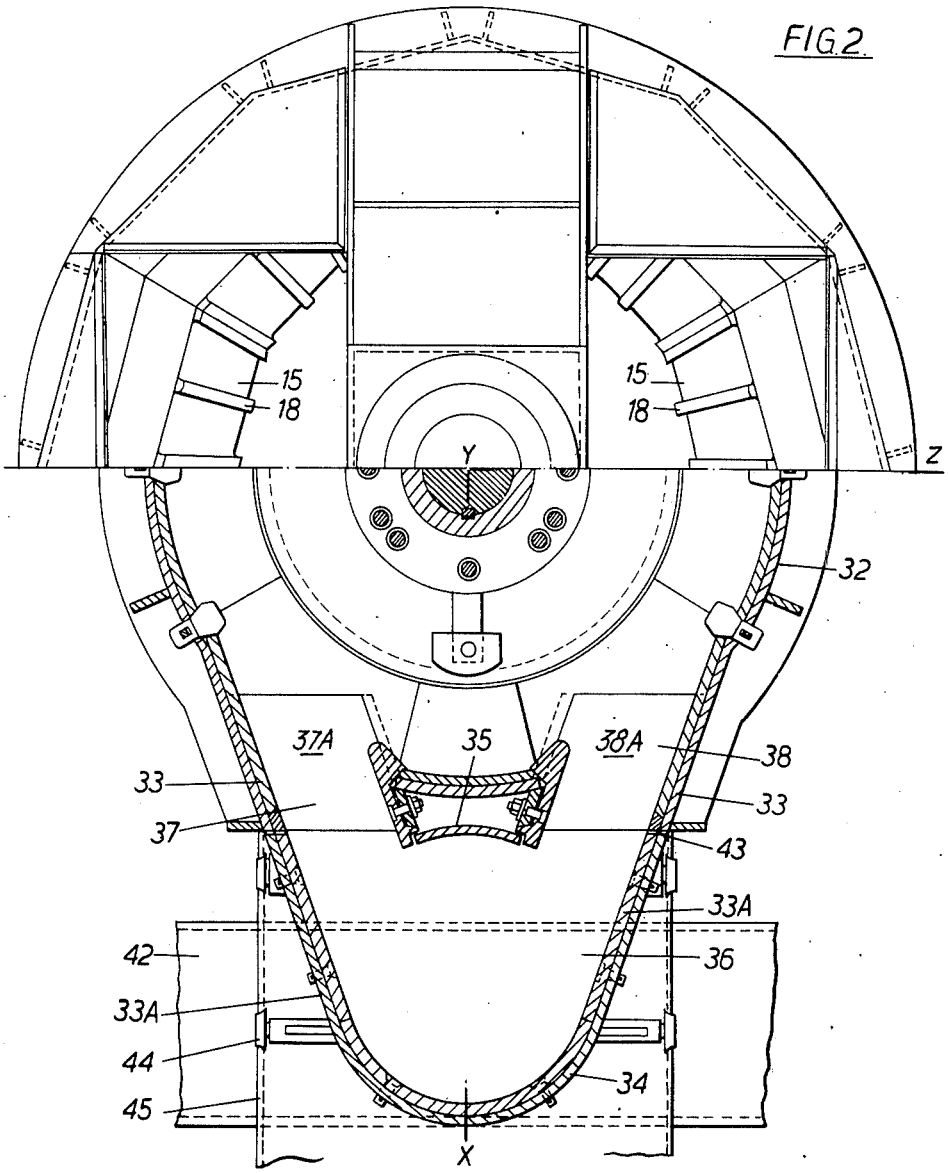
FIG. 2 is a plan view in half section, the half section being taken along the line AA of FIG. 1.

It will be noted from FIG. 2 that the portions 33A of wall 33 are separated at junction points 43 from the remainder of the wall 33. The assembly comprising the portions 33A and the arcuate wall 34 is mounted on a carriage which is provided with wheels 44, which can run on a track 45 enabling the chamber 36 to be removed as a whole from the remainder of the apparatus for servicing purposes.

In use of the above described apparatus, the motor 25 is turned on so that the shaft 19 and its associated parts 24, and 26 to 31 rotate. The material to be pulverised, e.g. municipal refuse, is introduced through an opening 41 in the top wall 21. The more resilient objects are struck by the hammers and are thrown out again through an outlet opening (not shown) in the upper wall 21. The remaining material is drawn downwardly and this is largely pulverised by the action of the hammers within the ring 15 provided with the ribs 18. The material proceeds further downwardly and is finally pulverised to the finished size by the further set of sets of hammers in the cylindrical portion 32. As indicated a down draught of air is produced in the housing 10 by the action of the flails and this air is expelled radially outwardly from the cylindrical portion 32, through the passageway 37 or the passageway 38, depending on direction of rotation of the motor. The material is carried by the air into the separator chamber 36 and cyclonic separation takes place therein, the air being drawn upwardly through the tube 39, while the particulate material falls onto the conveyor and is extracted. A portion of this conveyor is illustrated in FIG. 2 and is indicated by the reference 42.

During the cyclonic separation the material falls downwardly past base 38A into the chamber 36 and this base 38A tends to prevent material being returned to the cylindrical portion 32.

The polygonal array of the plates of the funnel portion has two main advantages. Firstly it facilitates the manufacture of the funnel portion. Secondly it improves the pulverising effect, (a) because rotation of the material within the funnel portion is severely reduced as compared with a conical shaped funnel and (b) because the different clearances between the hammer or hammers and the wall of the funnel (a maximum at an angle between faces and a minimum at the centre of the face of the polygon) can produce better shearing action for articles of different size in the material being handled.

We claim:

1. A pulveriser separator comprising, in combination:

a. a housing;

b. an upwardly divergent funnel portion consisting of a plurality of imperforate pulveriser plates disposed to provide a polygonal cross-sectional inner perforate for the funnel, said plates comprising inner skin plates and outer skin plates, the inner skin plate of each face of the polygon being formed by a plurality of axially adjacent plate portions.

c. a downwardly depending skirt portion of said housing extending downwardly from said funnel portion; and d. at least one hammer mounted for rotation about the substantially vertical axis within said housing.

2. A pulveriser as claimed in claim 1, wherein the lowermost plate portions of the inner skin plate nearest the skirt portion are formed of cast manganese steel.

3. A pulveriser as claimed in claim 1, wherein the lowermost plate portion of the inner skin plate nearest the skirt portion has radially inwardly projecting, axially extending ribs thereon.

4. A pulveriser as claimed in claim 1, wherein there are three axially adjacent plate portions on each said face.

5. A pulveriser as claimed in claim 1, wherein said at least one hammer is mounted for rotation in the lowermost part of the funnel portion.

6. A pulveriser as claimed in claim 1, wherein said at least one hammer is a double-headed hammer mounted to rotate about the axis in either direction.

* * * * *